United States Patent [19]

Shimano

[11] Patent Number: 4,642,981

[45] Date of Patent: Feb. 17, 1987

[54] ROTOR WITH YARN GUIDE FOR OPEN-END SPINNING

[75] Inventor: Akira Shimano, Kyoto, Japan

[73] Assignee: Murata Kikai Kabushiki Kaisha, Kyoto, Japan

[21] Appl. No.: 793,295

[22] Filed: Oct. 31, 1985

[30] Foreign Application Priority Data

Nov. 6, 1984 [JP] Japan ..... 59-233434

[51] Int. Cl.[4] ..... D01H 1/135; D01H 7/885; D01H 7/90

[52] U.S. Cl. ..... 57/414; 57/333; 57/350; 57/415; 57/417

[58] Field of Search ..... 57/327, 225, 328, 224, 57/333, 350, 400, 407, 404, 408, 409, 411, 413–417

[56] References Cited

U.S. PATENT DOCUMENTS

| | | | |
|---|---|---|---|
| 4,166,354 | 9/1979 | Duba | 57/417 |
| 4,219,996 | 9/1980 | Edgawa et al. | 57/225 |
| 4,458,477 | 7/1984 | Raasch et al. | 57/417 X |
| 4,479,348 | 10/1984 | Yasui et al. | 57/404 |
| 4,565,064 | 1/1986 | Iwasaki et al. | 57/414 X |

*Primary Examiner*—John Petrakes

*Attorney, Agent, or Firm*—Barnes, Kisselle, Raisch, Choate, Whittemore & Hulbert

[57] ABSTRACT

A fiber bundle produced by feeding combed fibers into a rotating rotor to accumulate the fibers over the inner circumference of the rotor is drawn out therefrom and is introduced into a false twisting unit, where the fiber bundle is false-twisted so that the twists are transmitted to a portion of the fiber bundle adjacent to the fibers accumulated over the inner surface of the rotor. A guide funnel having a guide surface extending near to the fiber accumulating surface is disposed within the rotor.

6 Claims, 5 Drawing Figures

ROTOR WITH YARN GUIDE FOR OPEN-END SPINNING

FIELD OF THE INVENTION AND RELATED ART STATEMENT

The present invention relates to a method of manufacturing a spun yarn from numerous combed fibers and to an apparatus for carrying out the same.

In a rotor type open-end spinning machine, numerous fibers are fed into a rotating rotor, the fibers fed to the rotor are accumulated over the inner circumference of the rotor by centrifugal force that acts on the fibers, and then the accumulated fibers are drawn out in a fiber bundle from the rotor in one direction to form a spun yarn by twisting the fiber bundle. The number of twists per unit length of the spun yarn is dependent on the revolving rate of the rotor relative to the speed of drawing out the fiber bundle.

In order to enhance the spinning speed of the above-mentioned open-end spinning machine, it is necessary to increase the revolving rate of the rotor. However, when the revolving rate of the rotor is increased, the centrifugal force that acts on the yarn is enhanced and, hence, the yarn tension is increased, which tends to cause yarn breakage. Furthermore, when the rotor is rotated at a high revolving rate, energy consumption rate is increased.

OBJECT AND SUMMARY OF THE INVENTION

It is an object of the present invention is to increase the spinning speed without entailing such problems of the conventional open-end spinning machine.

It is another object of the present invention to provide a novel method of manufacturing a spun yarn and an apparatus for carrying out the method.

According to the present invention, a fiber bundle drawn out from a rotor is introduced into a false twisting unit, where the fiber bundle false-twisted so that the twists are transmitted to a portion of the fiber bundle adjacent to the fibers accumulated over the fiber accumulating surface of the rotor. A guide funnel having a guide surface smoothly extending from the yarn guide hole near to the fiber accumulating surface is disposed within the rotor. The fiber bundle moves along the guide surface.

The false twists formed by the false twisting unit are transmitted through the fiber bundle near to the end portion thereof, and hence the fiber bundle has a portion having false twists and a portion not having any twist. The portion having false twists is further false-twisted as the fiber bundle is drawn out from the rotor, and then, the false-twisted portion is untwisted after passing the false twisting unit. Since the false-twisted fibers and fibers entwining around the false-twisted fibers are different in twist angle, the fibers entwining around the false-twisted fibers are twisted around the false-twisted and untwisted fibers in a direction reverse to the direction of the false twists, when the false-twisted fibers are untwisted after the same has passed through the false twisting unit. The guide funnel applies a preselected surface pressure to the fiber bundle to suppress tension variation in the fiber bundle so that the yarn will not be broken and the false twist are transmitted surely.

DESCRIPTION OF PREFERRED EMBODIMENTS

Figure 1:
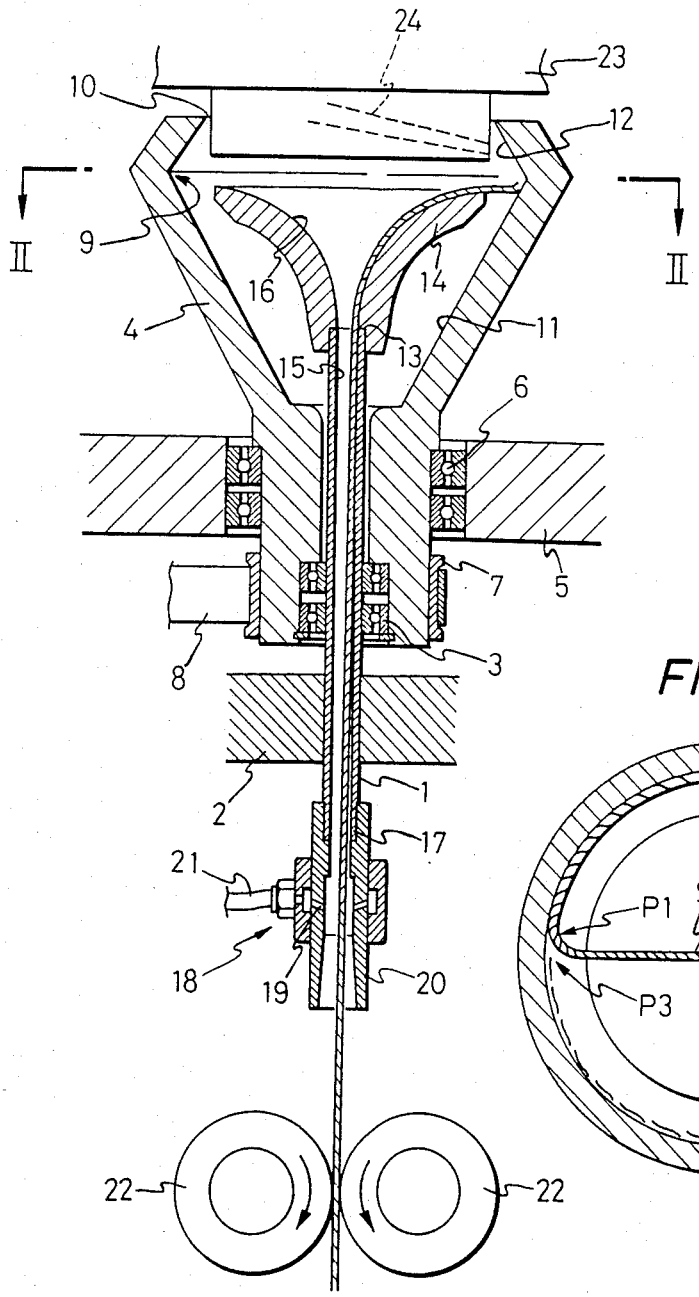
FIG. 1 is a sectional view of an apparatus according to the present invention.

FIG. 1 is a sectional view of an apparatus for manufacturing a spun yarn, according to the present invention. Referring to FIG. 1, a hollow yarn guide pipe 1 is fixedly supported by a frame 2 on the bed, not shown, of the apparatus. A rotor 4 is rotatably supported through bearings 3 on the yarn guide pipe 1 at the upper part of the yarn guide pipe 1. The rotor 4 is also rotatably supported in bearings 6 on a frame 5 of the apparatus. An endless driving belt 8 is wrapped around a pulley 7 fixed to the outer circumference of the base portion of the rotor 4. The driving belt 8 is driven by a driving source, not shown, to rotate the rotor 4 on the yarn guide pipe 1 at a high revolving speed. The rotor 4 is a hollow cylindrical or conical member having a concave fiber accumulating surface 9 in the inner dircumference of the upper section thereof and a circular opening 10 at the upper end thereof. The inner circumference of the rotor 4 consists of a lower conical inner circumference 11 expanding upward and formed near the base portion of the rotor and an upper conical inner circumference 12 expanding downward and formed near the circular opening 10. The fiber accumulating surface 9 corresponds to an area around the junction of the inner circumferences 11 and 12, where the inside diameter of the rotor 4 is the largest. The upper end of the yarn guide pipe 1 having a yarn inlet 13 is projecting into the rotor. A guide funnel 14 having a funnel shape is fixed to the upper end having the inlet hole 13. The inner surface of the guide funnel 14 forms a substantially conical guide surface 16 having an arcuate cross section smoothly extending from the inner surface, namely, a yarn guide hole 15, of the yarn guide pipe 1 near to the fiber accumulating surface 9 of the rotor. A yarn outlet 17 formed in the lower end of the yarn guide pipe 1 is connected to a false twisting unit 18. The false twisting unit 18 includes a false twisting nozzle 20 having nozzle holes 19 for injecting air and an air pipe 21 connected at one end thereof to the false twisting nozzle 20 and at the other end thereof to a compressed air source, not shown, to supply compressed air to the nozzle holes 19. The nozzle holes 19 are extended tangentially to the hollow interior of the false twisting nozzle 20 and at a small declivity toward the outlet of the false twisting nozzle 20, and open into the hollow interior of the false twisting nozzle 20. The compressed air injected through the nozzle holes 19 into the interior of the false twisting nozzle 20 flows toward the outlet of the false twisting nozzle in a swirling current. A pair of delivery rollers 22 pressed against each other are rotated in directions indicated by arrows, respectively, to draw out a yarn Y spun on this apparatus at a predetermined spinning speed. Indicated at 23 is a well-known fiber feeding device having an end portion extending into the opening 10 of the rotor 4. The fiber feeding device 23 combs a bundle of fibers, such as a sliver, with a combing roller, not shown, and then feeds the fibers to the rotor 4 by continuously blowing the combed fibers through a fiber passage 24 against the inner circumference of the rotor.

Figure 2:
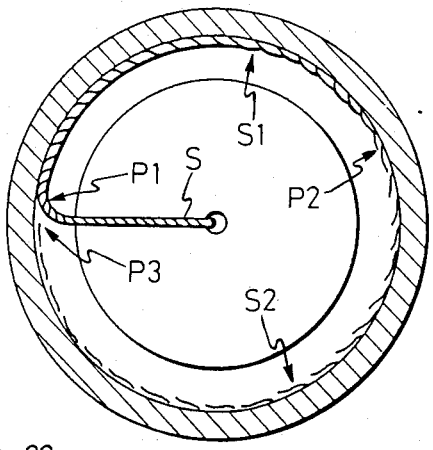
FIG. 2 is a sectional view taken along line II—II of FIG. 1, as viewed in the direction indicated by arrows.

In the above-mentioned apparatus, numerous fibers f fed through the fiber passage 24 of the fiber feeding device 23 are accumulated over the fiber accumulating surface 9 in a looped fiber bundle as shown in FIG. 2 by the agency of the centrifugal force generated by the rotation of the rotor 4 and acting on the fibers. The fiber bundle S thus formed over the fiber accumulating surface 9 is separated from the fiber accumulating surface 9 at a position on the same and is drawn out along the guide surface 16 of the guide funnel 14 and through the guide hole 15 of the guide pipe 1. Then, the fiber bundle S is twisted and untwisted on the false twisting unit 18 to be a spun yarn Y, then the spun yarn Y is drawn by the delivery rollers 22, and then the spun yarn Y is wound on a bobbin, not shown.

Figure 3:
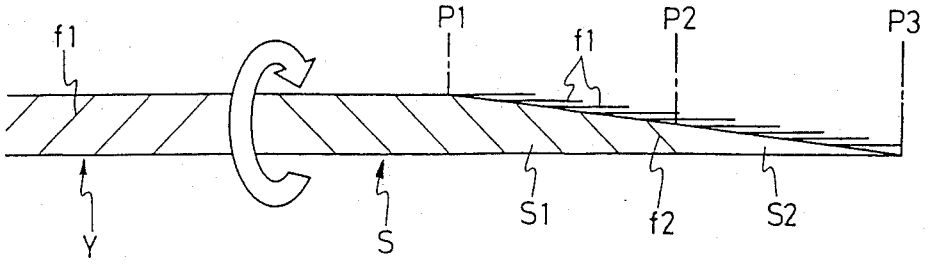
FIG. 3 is a typical illustration of assistance in explaining the process of forming a spun yarn.

The fiber bundle S is twisted in a certain twisting direction by the rotating rotor 4 as the same is drawn out from the rotor 4 and also is false-twisted on the false twisting unit 18 by the compressed air injected into the false twisting nozzle 20 of the false twisting unit 20. The twisting direction of the false twists is the same as that of the twists inserted into the fiber bundle S by the rotor, and the number of the false twists is several times that of the twists inserted by the rotor. The false twists are transmitted through the fiber bundle S back to a portion thereof within the rotor. The false twists are transmitted from the false twisting unit 18 through the fiber bundle S to the fiber accumulating surface 9. The false twists are inserted into the fiber bundle S over the entire length thereof except the end portion adjacent to the fiber accumulating surface 9 as illustrated in FIG. 2. That is, the transmission of the false twists is prevented by the friction between the fiber bundle S and the fiber accumulating surface 9 at a position P2, and hence the fiber bundle S has a false-twisted section S1 and a no-twist section S2. Suppose that the fiber bundle S leaves the fiber accumulating surface 9 at a position P1 and the tail end of the fiber bundle S is at a position P3. Then, the fibers f feed through the fiber passage 24 into the rotor 4 entwine around the false-twisted fiber bundle S1 between the positions P1 and P2 and are accumulated in parallel to each other between the positions P2 and P3. FIG. 3 is a schemetic illustration showing the process in which the fiber bundle is formed. Referring to FIG. 3, the twist angle of the fibers f1 fallen on the false-twisted fiber bundle S1 between the positions P1 and P2 is different from that of the component fibers f2 of the false twisted fiber bundle S1. True twists of the same twisting direction as the false twists are inserted into the fiber bundle S by the rotation of the rotor 4 as the fiber bundle is drawn from the fiber accumulating surface 9 to the false twisting unit 18. The false twists are untwisted after the fiber bundle has passed the false twisting unit 18. Thus, the resultant yarn Y consists of fibers forming the central portion thereof having the true twists and fibers entwining in the reverse twisting direction around the fibers of the central portion of the yarn. The fibers entwining around the fibers of the central portion of the yarn Y are the fibers f1 fallen on the false-twisted fiber bundle S1 between the positions P1 and P2. The difference between the fibers of the central portion and the entwining fibers in twist angle causes the fibers f1 to entwine around the fibers of the central portion in the reverse twisting direction. The yarn Y thus spun has a double construction consisting of fibers twisted in opposite twisting direction, and hence the yarn Y generally has a very small residual torque.

In manufacturing the above-mentioned spun yarn Y, the guide funnel 14 functions effectively for making the f false twists inserted into the fiber bundle by the false twisting unit 18 are transmitted to the fiber bundle formed over the fiber accumulating surface 9 of the rotor 4. When the guide funnel 14 is not provided, kinks are lieble to be formed in the fiber bundle S between the inlet 13 of the yarn guide pipe 1 and the fiber accumulating surface 9 due at tension variation, which impedes the transmission of the false twists, and hence the false twists are unable to be transmitted over the position P1. Consequently, a desired yarn cannot be produced. Furthermore, in such a condition, since the false twists are concentrated in the portion of the fiber bundle between the inlet 13 and the fiber accumulating surface 9, the fiber bundle is liable to break. The centrifugal force acting on the fiber bundle S presses the fiber bundle S against the inclined guide surface 16 of the guide funnel 14, which prevents false twists forming kinks in the fiber bundle S between the inlet 13 of the yarn guide pipe and the fiber accumulating surface 9 and also suppresses the vibration of the fiber bundle S so that the false twists are able to be transmitted smoothly. Accordingly, the substantial inclination of the guide surface 16, namely, the angle a between a straight line connecting the upper and lower edges of the guide surface 16 and a vertical line, needs to be an angle within the range of 30 to 60 degrees, preferably, about 45 degrees. It is also preferable to reduce the gap b between the upper edge, namely, the outer periphery, of the guide surface 16 and the inner circumference of the rotor to the least possible extent. When the angle a is greater than 60 degrees, the pressure acting between the fiber bundle S and the guide surface 16 is reduced. When the gap b is greater than 20 mm, kinks are liable to be formed in the fiber bundle S in a portion thereof corresponding to the gap. In order to press the fiber bundle uniformly against the guide surface 16, preferably, the guide surface 16 is a convex surface as that employed in this embodiment, however, the guide surface 16 may be a surface formed by straight lines or, if necessary, a concave surface. The upper peripheral edge of the guide surface 16 is located on the side of the lower conical inner circumference 11 below the junction of the lower and upper conical inner surfaces 11 and 12 by a distance c to bend the fiber bundle S gradually between the fiber accumulating surface 9 and the upper peripheral edge of the guide surface 16 so that the fiber bundle S is transferred smoothly from the fiber accumulating surface 9 to the guide surface 16. The distance c is a value within the range of 1 to 4 mm, preferably, about 2 mm.

Figure 4:
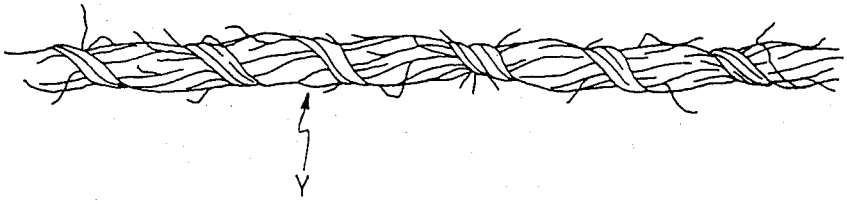
FIG. 4 is an external view of a spun yarn manufactured according to the present invention.
Figure 5:
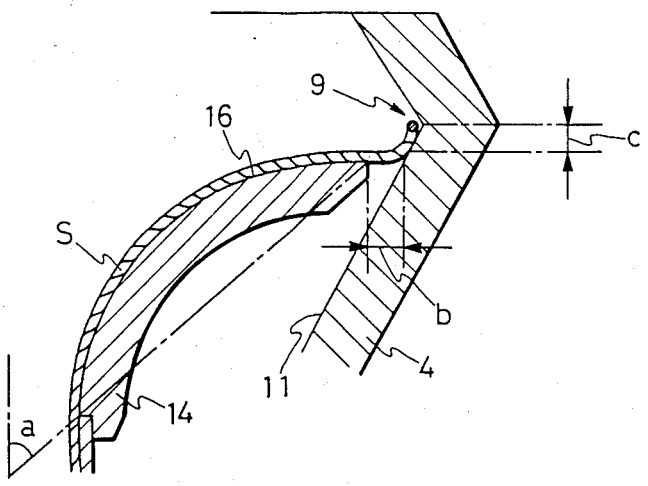
FIG. 5 is an enlarged fragmentary sectional view showing part of the rotor and the guide funnel.

As described hereinbefore, in this apparatus, the rotor 4 needs to be rotated only at a revolving speed necessary for accumulating fibers f over the fiber accumulating surface 9 by centrifugal force; and this revolving speed is far lower than the revolving speed of the rotor of the conventional rotor type open-end spinning machine. When a 20 Ne spun yarn is spun on the apparatus of the present invention under spinning conditions: 150 m/min drawing speed and 20, 000 rpm rotor speed, the twist multiplier of the central portion of the yarn is as small as 0.75. However, as illustrated in FIG. 4, since fibers entwine around the fibers of the central portion of the yarn, the yarn Y has a sufficient strength. The number of the false twists inserted into the yarn by injecting air into the false twisting unit 18 is far greater than the number of the true twists inserted into the yarn by the rotation of the rotor, namely, the number of the false twists is several times that of the true twists, sufficient fibers for forming the yarn Y are made to entwine around the fibers of the central portion. The false twisting unit 18 is not limited to such a false twisting unit using compressed air for false-twisting the fiber bundle, but a so-called belt type false twisting unit which false-twists a yarn or a fiber bundle between two endless belts disposed opposite to each other and driven for running in opposite directions, respectively, may be employed.

According to the present invention, high-speed spinning operation is achieved by rotating the rotor at the same revolving speed as or at a lower revolving speed that that of the rotor of the conventional open-end spinning machine.

What is claimed is:

1. An apparatus for manufacturing a spun yarn comprising:

(a) a rotor having a recess with a fiber accumulating surface in the inner surface thereof at the conjunctive base surface of two oppositely disposed conical surfaces, and a yarn guide hole formed coaxially with the axis of rotation, (b) means forming a yarn guide surface comprising a stationary yarn guide tube projecting into the yarn guide hole of said rotor and a funnel guide surface expanding outwardly from said yarn guide tube into said recess of said rotor, said funnel surface extending smoothly from said guide tube to an outer diameter closely adjacent said fiber accumulating surface of said rotor, and (c) a pneumatic false twisting unit in said guide tube spaced axially from said funnel wherein said false twisting unit can impart a false twisting component to fibers accumulating on said expanding funnel guide surface.

2. An apparatus as defined in claim 1 in which the general inclination of said funnel surface from said guide tube to said outer diameter is in the range of 30 to 60 degrees.

3. An apparatus as defined in claim 1 in which the location of said outer diameter of said funnel guide surface is radially spaced from the conjunction of said base surfaces a first predetermined distance and axially spaced downstream from the said conjunction a second predetermined distance so that a fiber bundle accumulating on said fiber accumulating surface can be smoothly transferred from the fiber accumulating surface to the funnel guide surface.

4. An apparatus as defined in claim 3 in which said first predetermined distance is less than 20 mm.

5. An apparatus as defined in claim 3 in which said second predetermined distance is in a range of 1 to 4 mm.

6. An apparatus as defined in claim 1 in which said funnel guide surface is shaped as a smooth convex surface from said concentric guide tube to said outer diameter.

* * * * *